United States Patent [19]

Zeller

[11] 4,064,365

[45] Dec. 20, 1977

[54] LOUDSPEAKER ASSEMBLY WITH RESTRUCTURED DIAPHRAGM INCLUDING A TWEETER DRIVEN BY A BASS AMPLIFIER

[75] Inventor: David M. Zeller, Seattle, Wash.

[73] Assignee: The Raymond Lee Organization, Inc., New York, N.Y.

[21] Appl. No.: 757,002

[22] Filed: Jan. 5, 1977

[51] Int. Cl.[2] ..... H04R 1/24; H04R 7/12

[52] U.S. Cl. ..... 179/1 E; 179/181 F; 181/165

[58] Field of Search ..... 179/1 E, 115.5 R, 181 R, 179/181 F; 181/148, 157, 163, 164, 165, 167, 171, 173, 174

*Primary Examiner*—George G. Stellar
*Attorney, Agent, or Firm*—Howard I. Podell

[57] ABSTRACT

A loudspeaker and enclosure which provides amplified bass sound. The assembly includes a conventional conical loudspeaker with one or more rings of plastic foam material bonded to the inside of the cone of the loudspeaker, and with each ring oriented in a plane parallel to the diaphragm of the loudspeaker. A plastic cone is fitted through the central opening of the rings for transmission of treble sounds. The loudspeaker may be mounted to a circular hole on a wall of a cube-shaped enclosure. The plastic cone may terminate at the wall of the enclosure or project beyond the enclosure.

3 Claims, 10 Drawing Figures

LOUDSPEAKER ASSEMBLY WITH RESTRUCTURED DIAPHRAGM INCLUDING A TWEETER DRIVEN BY A BASS AMPLIFIER

SUMMARY OF THE INVENTION

My invention is a loudspeaker and enclosure which provides amplified bass sound. The assembly includes a conventional conical loudspeaker with one or more rings of plastic foam material bonded to the inside of the cone of the loudspeaker, and with each ring oriented in a plane parallel to the diaphragm of the loudspeaker. A plastic cone is fitted through the central opening of the rings for transmission of treble sounds. The Loudspeaker may be mounted to a circular hole on a wall of a cube-shaped enclosure. The plastic cone may terminate at the wall of the enclosure or project beyond the enclosure.

BRIEF DESCRIPTION OF THE DRAWINGS

The objects and features of the invention may be understood with reference to the following detailed description of an illustrative embodiment of the invention, taken together with the accompanying drawings in which.

Figure 1:
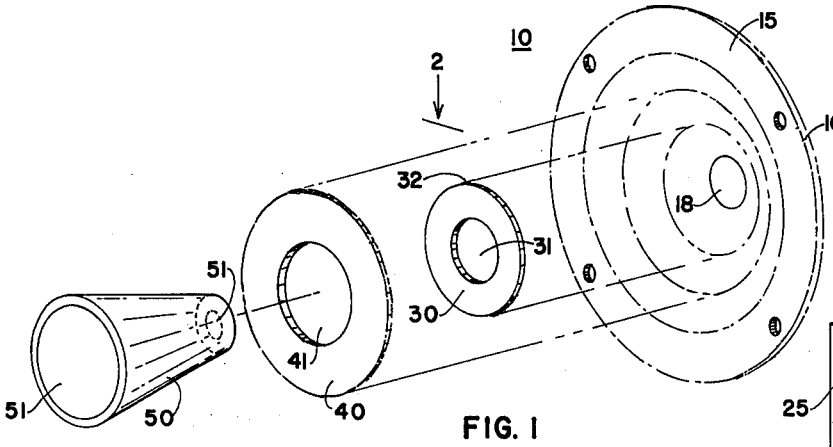
FIG. 1 is an exploded view of the loudspeaker.
Figure 2:
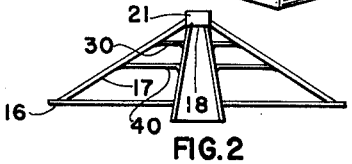
FIG. 2 is a side sectional view of the loudspeaker, taken along lines 2—2 of FIG. 1.

DESCRIPTION OF THE PREFERRED EMBODIMENT:

Turning now descriptively to the drawings, in which similar reference characters denote similar elements throughout the several views, FIGS. 1-2 illustrate the loudspeaker 10 which is mounted in the enclosure 20 shown in FIGS. 3-9.

Figure 3:
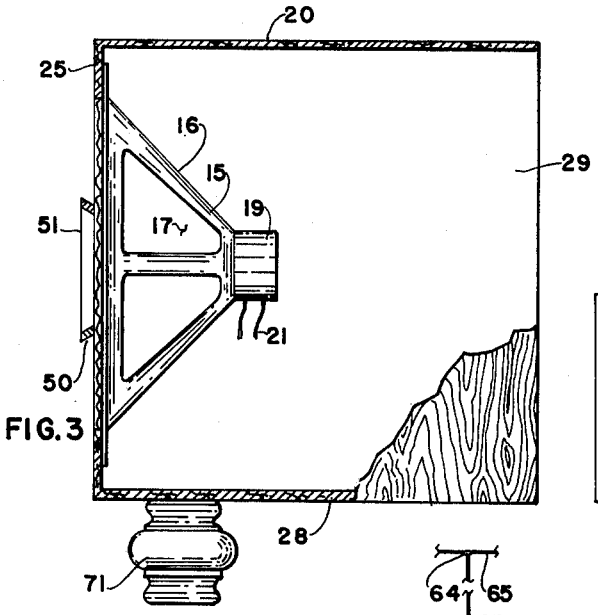
FIG. 3 is a side view of the loudspeaker mounted on the enclosure.
Figure 7:
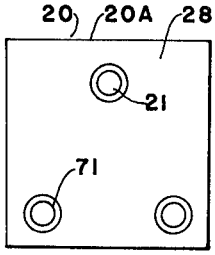
FIG. 7 is a bottom plan view of the assembly fitted with three legs.
Figure 8:
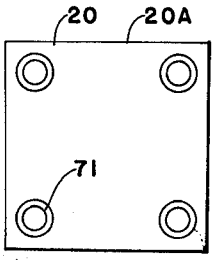
FIG. 8 is a bottom plan view of the assembly fitted with four legs.

Loudspeaker 10 is formed of a conventional loudspeaker unit 15 formed of a frame 16 in which a paper cone 17 (FIG. 2) is fitted to the diaphragm 18 of a coil and magnet unit 19 (FIG. 3) connected by wires 21 to the output of a bass amplifier unit (not shown). A first circular disc 30 fitted with a concentric hole 31 is fitted internally to loudspeaker cone 17, and with the periphery 32 of disc 30 bonded to cone 17, and with disc 30 generally parallel to diaphragm 18. A second circular disc 40 of a larger circumference than first disc 30 is similarly bonded to loudspeaker cone 17 parallel to, and at a spaced distance from, first disc 30. Disc 40 is formed with a concentric hole 41, with discs 30 and 40 serving as baffles to amplify the bass response of loudspeaker cone 17. Holes 31 and 41 are each of a size to snugly fit about the exterior of a hollow truncated cone 50 which is mounted to loudspeaker cone 17 at the juncture of loudspeaker cone 17 and the circumference of diaphragm 18, with the small opening 51 of cone 50 mounted adjacent to diaphragm 18 and the large opening 53 of cone 50 extending beyond the loudspeaker unit 15 and the forward face 25 of enclosure 20 as shown in FIG. 3 and with cone 50 serving to conduct the treble sounds from diaphragm 18. Alternately, as shown in FIGS. 4-6 and FIG. 9, the large opening 53 of cone 50 may lie in the plane of the forward wall 25 of loudspeaker enclosure 20A to which frame 16 is internally fastened.

Enclosures 20 and 20A are formed of resilient sheet material such as plastic, paperboard or wood in the form of a hollow cube, with a circular opening 26 in the forward wall 25 mounted to similar size side walls 26, top wall 27 and bottom wall 28, with the rear face 29 of enclosure 20 or 20A open.

Figure 4:
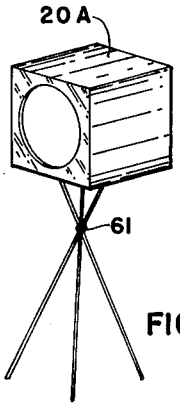
FIG. 4 is a perspective view of the assembly mounted on a tripod.
Figure 5:
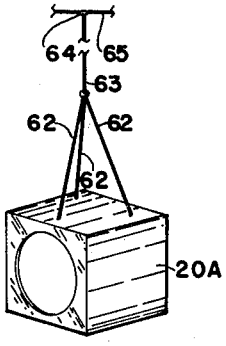
FIG. 5 is a perspective view of the assembly hung from a ceiling.
Figure 6:
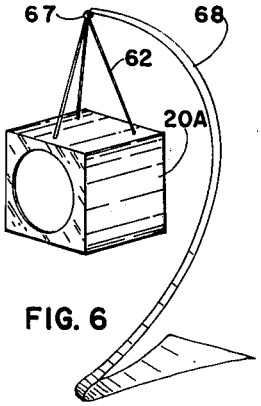
FIG. 6 is a perspective view of the assembly hung from a stand.

As shown in FIG. 4, enclosure 20A may be mounted on a tripod 61 or suspended by three wires 62 hung from a wire 63 attachable by a hood 64 to a ceiling 65, or alternately suspended by three wires 62 hung from a common eye 67 fitted to a stand 68 resting on a floor or table, as shown in FIGS. 5 and 6.

Alternately, enclosure 20 or 20A may be mounted on three or four legs 71 fixed to bottom panel 28.

Figure 10:
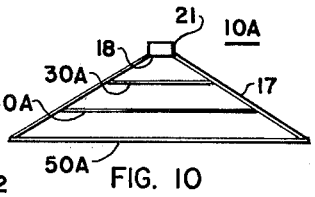
FIG. 10 is a sectional view of a bass speaker.
Figure 9:
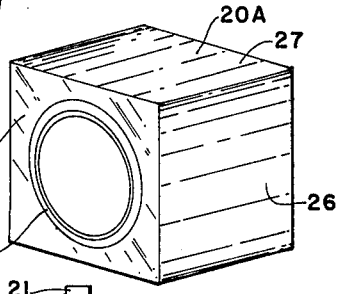
FIG. 9 is a perspective view of the assembly.

Alternately, as shown in FIG. 10, loudspeaker 10A may be formed with spaced solid parallel discs 30A, 40A and 50A bonded to the inside face of loudspeaker cone 17 to serve as a woofer or bass speaker, which is preferably supported in an enclosure 20A as shown in FIGS. 4-7 so as to separate the external surface of box 20A from a floor or wall surface.

A combination of speakers 10 and 10A may be connected with cross-over networks to provide a balanced sound reproduction and to give a stereo effect to sound amplified from a monaural source.

Since obvious changes may be made in the specific embodiment of the invention described herein, such modifications being within the spirit and scope of the invention claimed, it is indicated that all matter contained herein is intended as illustrative and not as limiting in scope.

Having thus described the invention, what I claim as new and desire to secure by Letters Patent of the United States is:

1. A loudspeaker assembly fitted with bass amplifier means, comprising, a conical loudspeaker unit mounted on a frame, said loudspeaker unit fitted with a first truncated cone that mounts about a diaphragm of a loudspeaker magnet coil assembly, a plurality of parallel spaced baffles fitted to the inside of said first cone, each said baffle in the form of a circular disc fitted with a concentric hole, said holes of a size to snugly fit about the exterior of a second hollow truncated cone mounted to the periphery of the said diaphragm, said second cone increasing in cross-sectional diameter in the direction away from said diaphragm.

2. The combination as recited in claim 1 in which the loudspeaker assembly is mounted in a cube-shaped enclosure.

3. The combination as recited in claim 2 in which the second cone extends beyond the exterior of the enclosure.

* * * * *